US012507846B2

(12) United States Patent
Maeta et al.

(10) Patent No.: US 12,507,846 B2
(45) Date of Patent: Dec. 30, 2025

(54) TOILET DEVICE

(71) Applicant: TOTO LTD., Kitakyushu (JP)

(72) Inventors: Katsushi Maeta, Kitakyushu (JP); Masayuki Mochita, Kitakyushu (JP); Kensaku Taira, Kitakyushu (JP); Satoshi Kawada, Kitakyushu (JP); Yuki Ko, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 18/176,554

(22) Filed: Mar. 1, 2023

(65) Prior Publication Data

US 2023/0292964 A1 Sep. 21, 2023

(30) Foreign Application Priority Data

Mar. 15, 2022 (JP) ..... 2022-040478

(51) Int. Cl.
*A47K 13/30* (2006.01)

(52) U.S. Cl.
CPC ..... *A47K 13/30* (2013.01)

(58) Field of Classification Search
CPC ..... A47K 13/307; A47K 13/10; E03D 11/13
See application file for complete search history.

(56) References Cited

U.S. PATENT DOCUMENTS 6,292,956 B1 * 9/2001 Kayahara ..... E03D 11/13 4/421
6,701,538 B2 * 3/2004 Hunnicutt, Jr. ..... A47K 13/307 4/213
8,082,607 B2 * 12/2011 Matsushita ..... A47K 13/302 4/444
10,053,576 B2 * 8/2018 Niu ..... A47K 1/00
10,738,454 B2 * 8/2020 Spankowski ..... E03D 11/02
11,396,744 B2 * 7/2022 Sato ..... E03D 3/00
11,739,518 B2 * 8/2023 Shiohara ..... E03D 11/13 4/420
2008/0060119 A1 * 3/2008 Pinizzotto ..... E03D 9/005 4/217
2009/0217447 A1 9/2009 Matsushita et al.
2019/0200820 A1 * 7/2019 Mochita ..... A47K 13/14
(Continued)

FOREIGN PATENT DOCUMENTS

JP 1295824 S 3/2007
JP 2007-319412 A 12/2007
(Continued)

OTHER PUBLICATIONS

Decision to Grant a Patent for Japanese Patent Application No. 2022-040478 dated Oct. 18, 2023.

*Primary Examiner* — David P Angwin
*Assistant Examiner* — Nicholas A Ros
(74) *Attorney, Agent, or Firm* — MCDONALD HOPKINS LLC

(57) ABSTRACT

A toilet device includes a toilet, a cover, a casing and a toilet lid. The cover laterally covers a back part of the toilet. The casing is located on the toilet. The toilet lid is rotatably supported with respect to the casing. A second gap between the casing and the cover, a third gap between the casing and the closed toilet lid, and a fourth gap between the toilet and the cover each are connected to a back end portion of a first gap. The first gap is between the toilet and the closed toilet lid when viewed laterally.

9 Claims, 9 Drawing Sheets

(56) References Cited

U.S. PATENT DOCUMENTS

| | | | | |
|---|---|---|---|---|
| 2019/0208820 | A1* | 7/2019 | Reevell | A24F 7/02 |
| 2022/0316198 | A1* | 10/2022 | Shiohara | E03D 11/13 |

FOREIGN PATENT DOCUMENTS

| | | | | | |
|---|---|---|---|---|---|
| JP | 2011-212133 | A | | 10/2011 | |
| JP | 2013-044151 | A | | 3/2013 | |
| JP | 5350006 | B2 | | 11/2013 | |
| JP | 2016089392 | | * | 5/2016 | E03D 9/02 |
| JP | 1572278 | S | | 3/2017 | |
| JP | 2017-148415 | A | | 8/2017 | |
| JP | 2017148415 | | * | 8/2017 | A47K 13/10 |
| JP | 1742622 | S | | 4/2023 | |
| TW | 200811340 | | * | 3/2008 | E03D 5/10 |
| WO | WO2021132261 | | * | 7/2021 | E03D 11/13 |

* cited by examiner

TOILET DEVICE

CROSS-REFERENCE TO RELATED APPLICATIONS

This application is based upon and claims the benefit of priority from Japanese Patent Application No. 2022-040478, filed on Mar. 15, 2022; the entire contents of which are incorporated herein by reference.

FIELD

Embodiments described herein relate generally to a toilet device.

BACKGROUND

For example, a toilet device includes a toilet, a toilet seat device located on the toilet, and a cover covering a backward side surface of the toilet. The toilet seat device includes, for example, a casing that includes a sanitary washing function and the like, and a toilet seat and a toilet lid that are mounted to the casing to be openable and closable.

In such a toilet t device, there are cases where contaminants such as water and the like adhere to the casing, spread to the toilet, the cover, or the like, and make cleaning a hassle.

SUMMARY

According to the embodiment, a toilet device includes a toilet, a cover, a casing and a toilet lid. The cover laterally covers a back part of the toilet. The casing is located on the toilet. The toilet lid is rotatably supported with respect to the casing. A second gap between the casing and the cover, a third gap between the casing and the closed toilet lid, and a fourth gap between the toilet and the cover each are connected to a back end portion of a first gap. The first gap is between the toilet and the closed toilet lid when viewed laterally.

DETAILED DESCRIPTION

Figure 1:
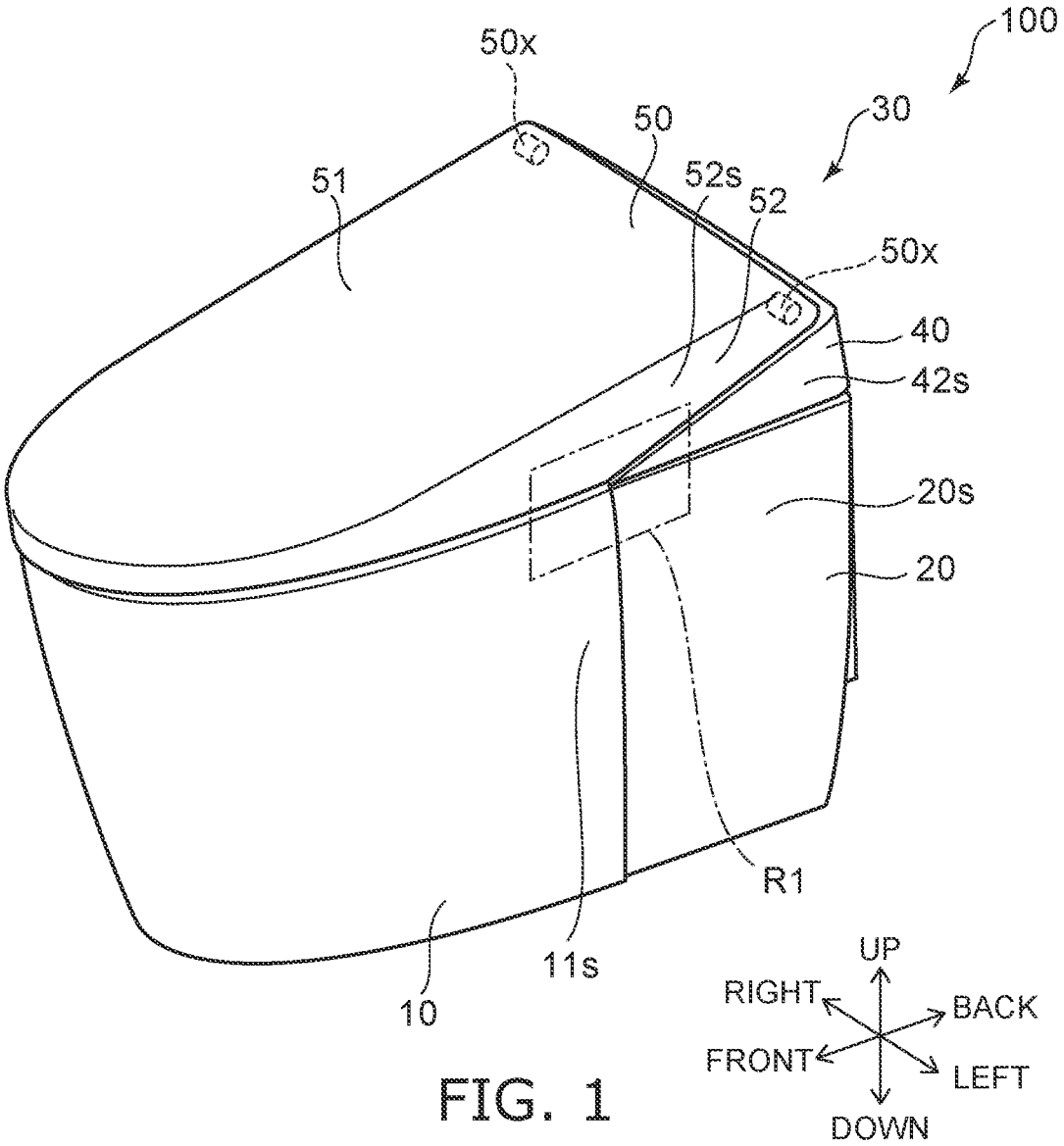
FIG. 1 is a perspective view illustrating a toilet device according to an embodiment.

A first invention is a toilet device including a toilet, a cover laterally covering a back part of the toilet, a casing located on the toilet, and a toilet lid rotatably supported with respect to the casing; and a second gap between the casing and the cover, a third gap between the casing and the closed toilet lid, and a fourth gap between the toilet and the cover each are connected to a back end portion of a first gap, the first gap being between the toilet and the closed toilet lid when viewed laterally.

According to the toilet device, the second to fourth gaps each are connected to the back end portion of the first gap; and the end portions of the first to fourth gaps are proximate to each other. Accordingly, for example, contaminants such as water, etc., from the third gap between the casing and the toilet lid that reach the upper surface of the toilet or cover easily enter the fourth gap between the toilet and the cover. Therefore, undesirable spreading of contaminants such as water, etc., to the upper surface of the toilet and/or cover positioned below the casing can be suppressed, and the cleanability can be improved.

A second invention is the toilet device of the first invention, wherein the fourth gap extends in a vertical direction.

According to the toilet device, the length of the fourth gap can be less than when the fourth gap is inclined with respect to the vertical direction. In other words, the gap in which contaminants such as water, etc., are likely to collect can be short, and the cleanability can be improved.

A third invention is the toilet device of the first or second invention, further including an opening/closing device that opens and closes the toilet lid, in which the closed toilet lid covers an upper surface of the casing.

According to the toilet device, the toilet lid covers the upper surface of the casing so that water droplets and/or dust can be prevented from penetrating between the toilet lid and the upper surface of the casing. Also, the toilet lid covers the upper surface of the casing so that the position of the center of gravity of the toilet lid can be located backward. Accordingly, the opening and closing of the toilet lid by the opening/closing device is easy.

A fourth invention is the toilet device of any one of the first to third inventions, further including a deodorizing device that is located in the casing and deodorizes air drawn from outside the casing, wherein the casing has an exhaust port located in a back surface of the casing, and the exhaust port exhausts the air deodorized by the deodorizing device.

According to the toilet device, the exhaust port is provided in the back surface, so that dirt and/or water droplets can be prevented from entering the casing through the exhaust port.

A fifth invention is the toilet device of any one of the first to fourth inventions, wherein a back surface of the casing includes a first inclined surface and a second inclined surface; the second inclined surface is inclined more than the first inclined surface with respect to a vertical direction; and a straight line extending through a boundary part between the first inclined surface and the second inclined surface crosses a straight line extending through the third gap.

According to the toilet device, the position of the boundary part and the position of the third gap are aligned so that the shape of the casing is simple, resulting in improved cleanability. Also, the designability can be improved.

Exemplary embodiments will now be described with reference to the drawings. Similar components in the drawings are marked with like reference numerals.

Figure 2:
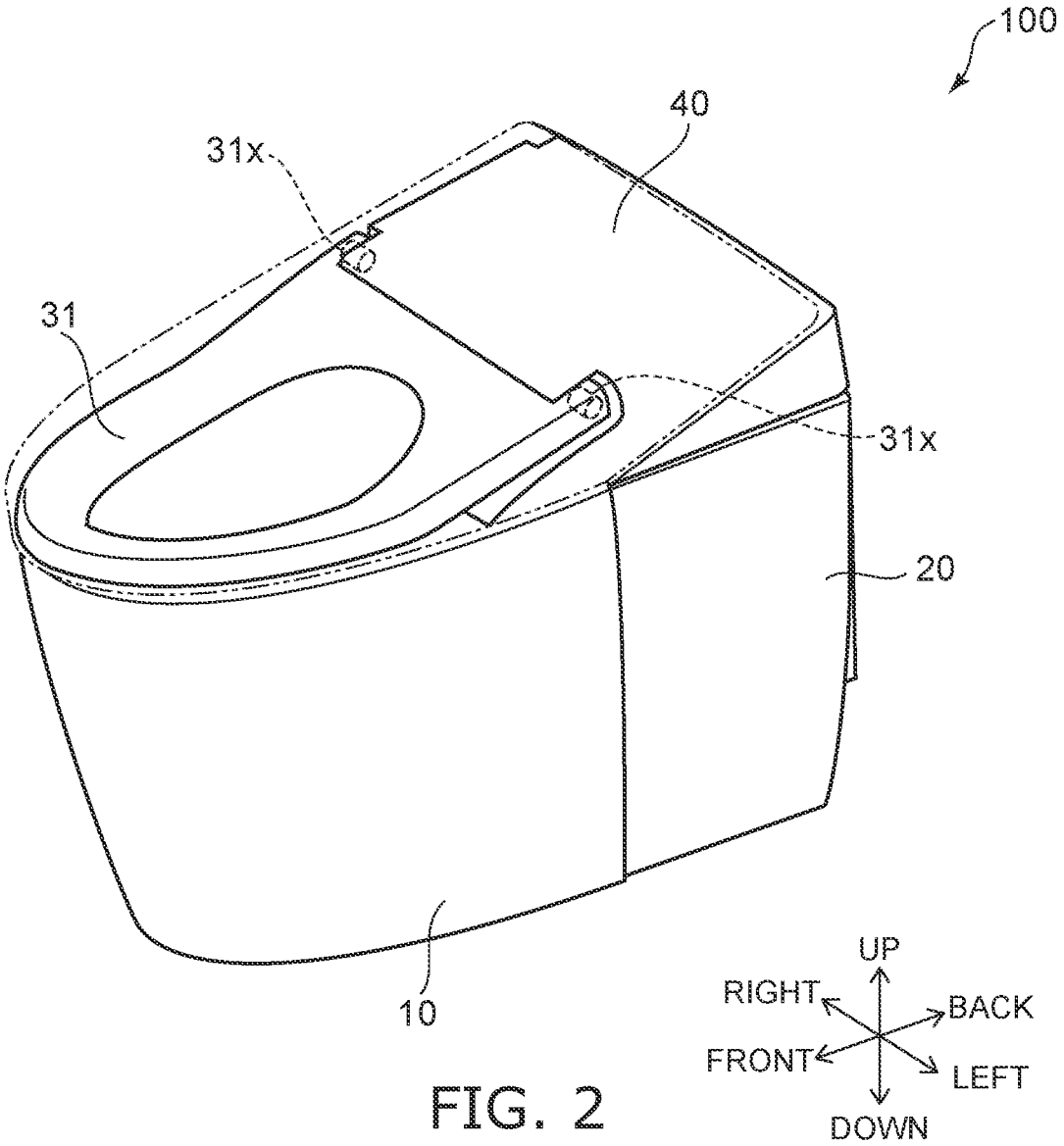
FIG. 2 is a perspective view illustrating the toilet device according to the embodiment.

FIGS. 1 and 2 are perspective views illustrating a toilet device according to an embodiment.

FIG. 1 illustrates a toilet device 100 according to the embodiment. A toilet lid 50 shown in FIG. 1 is not illustrated in FIG. 2; and the components below the toilet lid 50 are illustrated.

The toilet device 100 according to the embodiment includes a toilet 10, a cover 20, and a toilet seat device 30. In the example, the toilet 10 is a floor-mounted toilet. The toilet 10 is not limited thereto, and may be a so-called wall-hung toilet mounted to a wall surface, a front surface of a lining, etc. The cover 20 laterally covers the back part of the toilet 10. The cover 20 is, for example, a panel that is detachable from the toilet 10. The toilet seat device 30 is located on the toilet 10 and on the cover 20.

The toilet seat device 30 includes a casing 40 (a toilet seat device main part), a toilet seat 31, and the toilet lid 50. The casing 40 is located on the back side of the toilet 10 and on the cover 20. For example, the casing 40 is mounted to the toilet 10.

The toilet seat 31 and the toilet lid 50 each are rotatably supported with respect to the casing 40. In other words, the toilet seat 31 and the toilet lid 50 each are pivotally supported to be openable and closable. FIG. 1 illustrates a state in which the toilet seat 31 and the toilet lid 50 are closed (a state in which the toilet seat 31 and the toilet lid 50 are lowered). In the closed state, the toilet lid 50 covers the upper surfaces of the casing 40 and the toilet seat 31 from above.

More specifically, as illustrated in FIG. 1, an engaging part 50*x* (e.g., a hinge part having a shaft hole) for mounting the toilet lid 50 is located at the back end portion of the toilet lid 50. Two engaging parts 50*x* are laterally arranged. The toilet lid 50 is rotatably supported at the engaging parts 50*x*. As illustrated in FIG. 2, an engaging part 31*x* (e.g., a hinge part having a shaft hole) for mounting the toilet seat 31 is located at the back end portion of the toilet seat 31. Two engaging parts 31*x* are laterally arranged. The toilet seat 31 is rotatably supported at the engaging parts 31*x*.

As illustrated in FIG. 1, the toilet lid 50 includes a top plate part 51 and a sidewall part 52. The top plate part 51 forms the upper surface of the toilet lid 50 in the state in which the toilet lid 50 is closed. The sidewall part 52 extends downward from the outer perimeter of the top plate part 51 and forms the side surface of the toilet lid 50 in the state in which the toilet lid 50 is closed.

A body wash functional unit that enables washing of a human body private part (the "bottom" or the like) of a user sitting on the toilet seat 31, etc., are embedded inside the casing 40. Also, various mechanisms such as a "warm air drying function" that dries by blowing warm air toward the "bottom" or the like of the user sitting on the toilet seat 31, a "deodorizing unit", a "room heating unit", etc., may be provided in the casing 40 as appropriate.

In this specification, "up", "down", "front", "back", "left", and "right" each are directions when viewed by the user sitting on the toilet seat 31 with the back of the user toward the open toilet lid 50.

Figure 3:
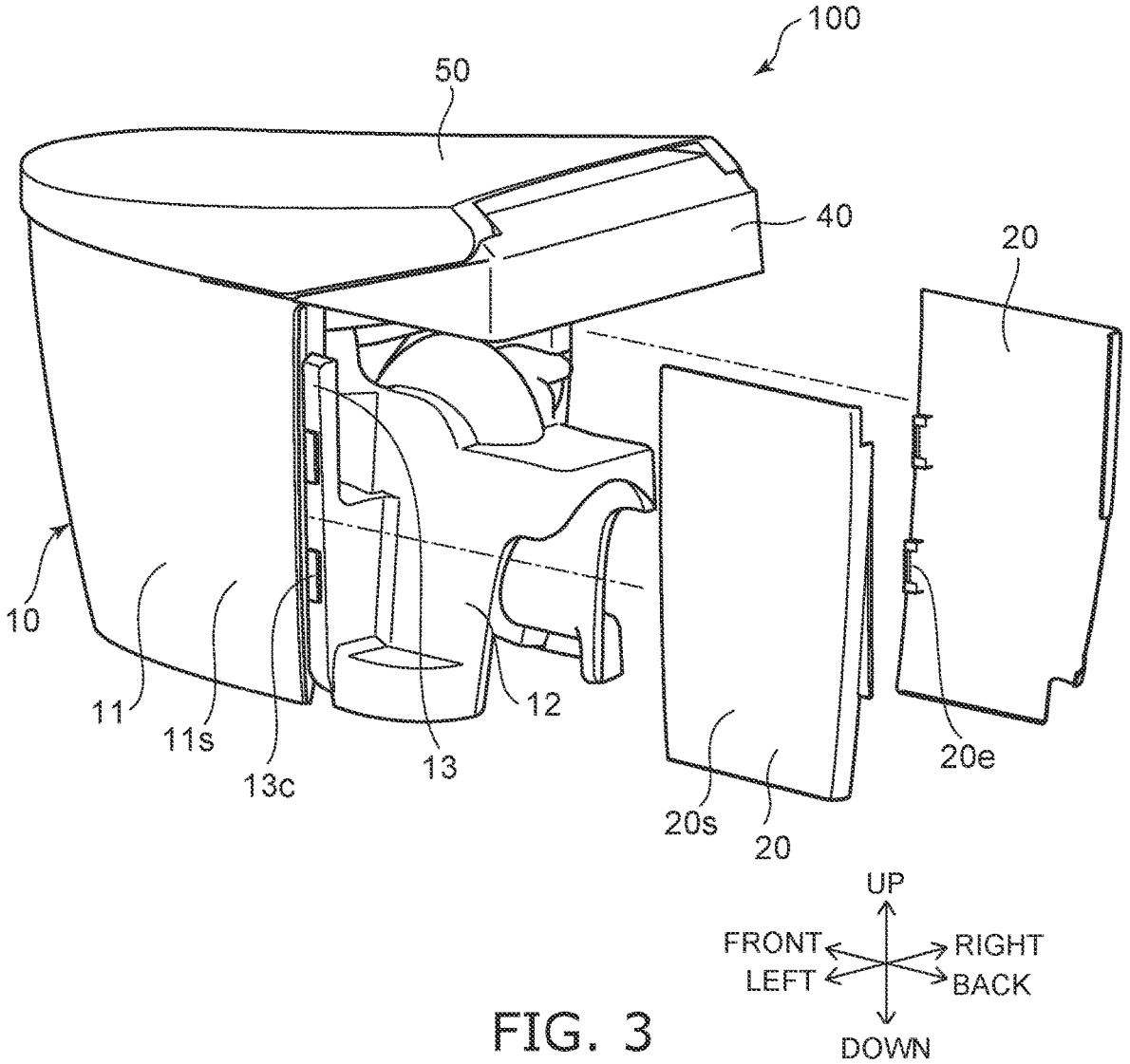
FIG. 3 is a perspective view illustrating the toilet device according to the embodiment.

FIG. 3 is a perspective view illustrating the toilet device according to the embodiment.

FIG. 3 illustrates the state in which the cover 20 is detached from the toilet device 100. The toilet 10 includes a sidewall part 11, and a back part 12 that is backward of the sidewall part 11. A cover mounting part 13 is located at the back end of the sidewall part 11. The cover mounting part 13 is recessed further inward than a surface 11*s* of the sidewall part 11 and extends in the vertical direction.

The cover 20 is arranged with the sidewall part 11 in the longitudinal direction, and is mounted to the cover mounting part 13 of the back end of the sidewall part 11. The toilet device 100 includes a pair of covers 20; the cover 20 at the right side covers the back part 12 from the right side; and the cover 20 at the left side covers the back part 12 from the left side.

In the example, the cover 20 is mounted to the toilet 10 by a magnetic force. A connection part 13*c* is provided in the cover mounting part 13. Also, a connection part 20*e* is provided in the front end part at the inner side of the cover 20 to correspond to the position of the connection part 13*c*. For example, a magnet is located at one of the connection part 13*c* or the connection part 20*e*; and a ferromagnetic body that is attracted to the magnet is located at the other of the connection part 13*c* or the connection part 20*e*. Accordingly, the cover 20 can be mounted to a prescribed position of the toilet 10. However, the embodiment is not limited to the description above; for example, the cover 20 may be mounted by any technique such as engaging parts (projections or tabs), screws, etc., that engage each other.

Figure 4:
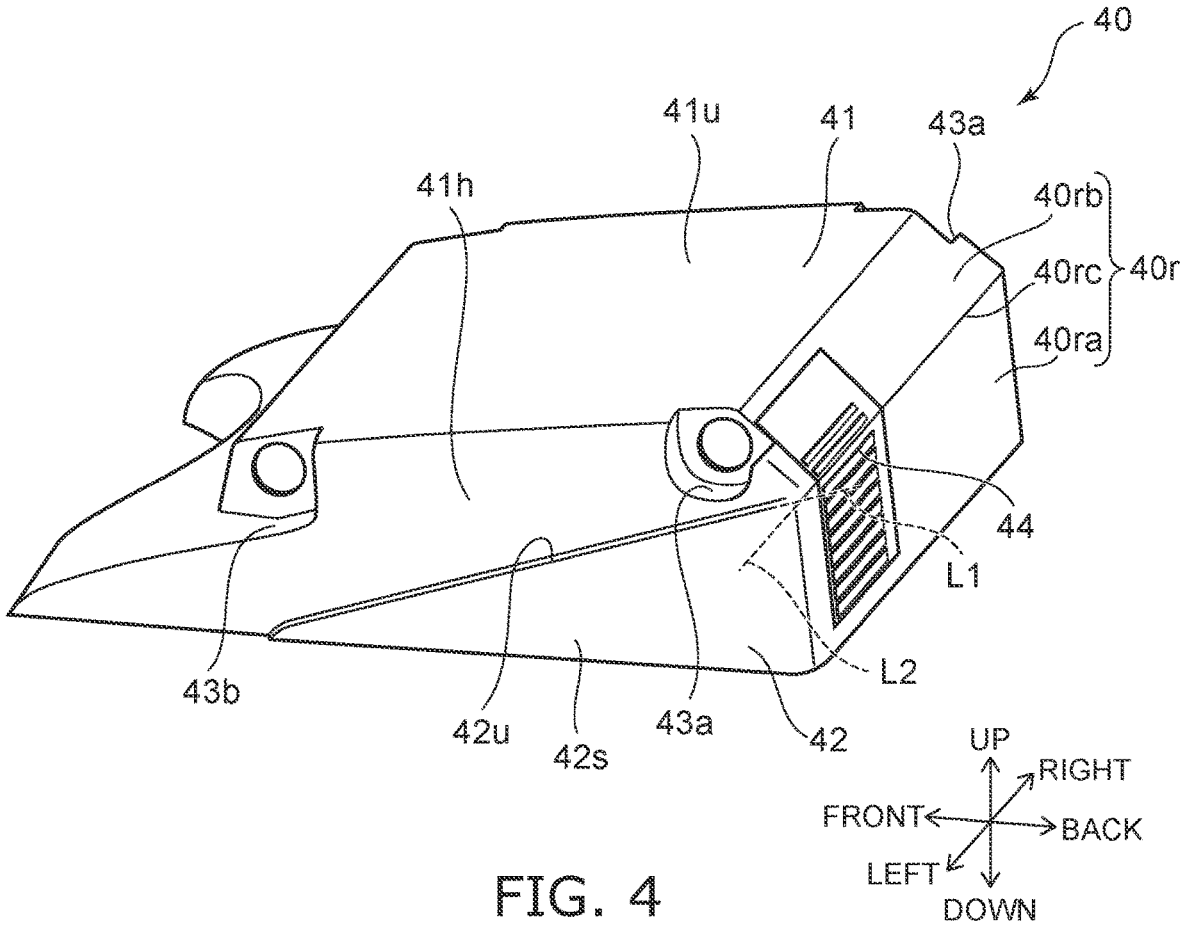
FIG. 4 is a perspective view illustrating the casing of the toilet seat device.

FIG. 4 is a perspective view illustrating the casing of the toilet seat device.

Figure 5:
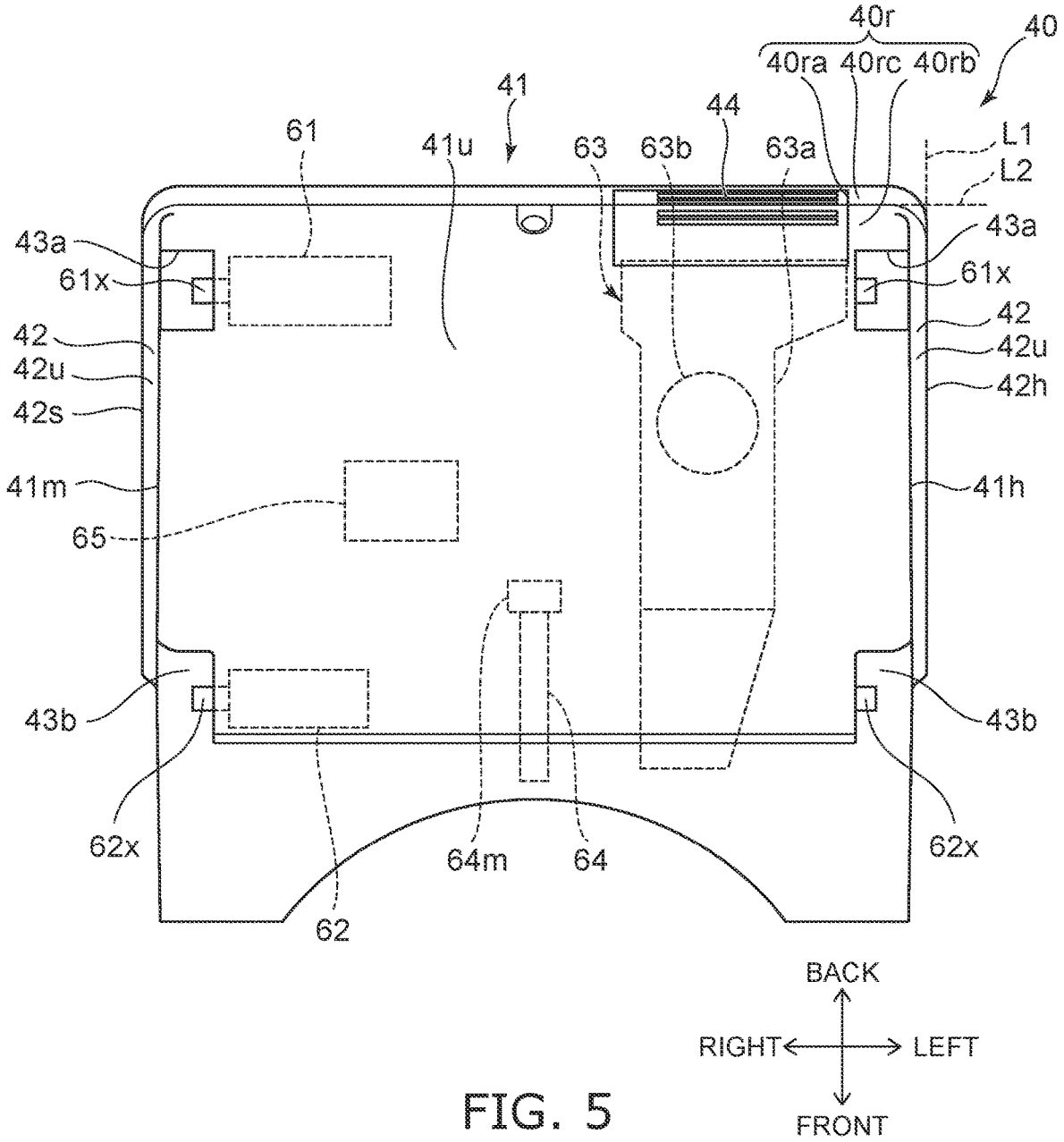
FIG. 5 is a plan view illustrating the casing of the toilet seat device.

FIG. 5 is a plan view illustrating the casing of the toilet seat device.

The casing 40 includes a central part 41 and a pair of side parts 42. The central part 41 includes an upper surface 41*u*, a right side surface 41*m*, and a left side surface 41*h*. The upper surface 41*u* has a downward incline frontward from the back. The upper surface 41*u* also is inclined downward from the center toward the right and left side surfaces 41*m* and 41*h*. The right side surface 41*m* and the left side surface 41*h* extend downward (e.g., substantially in the vertical direction) from the upper surface 41*u*.

The pair of side parts 42 is located respectively at the left and right of the central part 41. The side part 42 of the left side has a convex shape provided in the left side surface 41*h* of the central part 41. The side part 42 of the right side has a convex shape provided in the right side surface 41*m* of the central part 41.

The side part 42 includes an upper surface 42*u* and a side surface 42*s*. The upper surface 42*u* has a downward incline frontward from the back and extends from a back surface 40*r* of the casing 40 to the lower end of the casing 40. The side surface 42*s* extends downward (e.g., substantially in the vertical direction) from the upper surface 42*u* at the side end of the casing 40. As illustrated in FIG. 4, a step is formed between the upper surface 41*u* of the central part 41 and the upper surface 42*u* of the side part 42.

A pair of recesses 43*a* arranged in the lateral direction is provided in the back part of the upper surface 41*u* of the central part 41. As illustrated in FIG. 5, a rotary shaft 61*x* that extends laterally from the interior of the casing 40 is located in the recess 43*a*. The engaging part 50*x* of the toilet lid 50 is connected to the rotary shaft 61*x* in the recess 43*a*. The toilet lid 50 covers at least a part of the upper surface 41*u* of the casing 40 in the closed state. For example, the closed toilet lid 50 covers the entire upper surface 41*u*. The scope of "covering the entirety" includes not only the case where the entirety is completely covered, but also the case where substantially the entirety other than the end part of the upper surface 41*u*, etc., is covered.

A pair of recesses 43*b* (steps) arranged in the lateral direction are provided in the front part of the upper surface 41*u* of the central part 41. As illustrated in FIG. 5, a rotary shaft 62*x* that extends laterally from the interior of the casing 40 is located in the recess 43*b*. The engaging part 31*x* of the toilet seat 31 is connected to the rotary shaft 62*x* in the recess 43*b*.

The back surface 40*r* of the casing 40 includes a first inclined surface 40*ra* and a second inclined surface 40*rb*.

The first inclined surface 40*ra* is inclined with respect to the vertical direction. The second inclined surface 40*rb* is connected above the first inclined surface 40*ra* and is more inclined with respect to the vertical direction than the first inclined surface 40*ra*.

In the example illustrated in FIG. 5, the toilet seat device 30 includes an opening/closing device 61 (a toilet lid opening/closing device), an opening/closing device 62 (a toilet seat opening/closing device), a deodorizing device 63, a washing nozzle 64, a nozzle motor 64*m*, and a control circuit 65. These components are located inside the casing 40.

The opening/closing device 61 includes a motor that rotationally drives the rotary shaft 61*x*. The toilet lid 50 can be electrically opened and closed by rotating the rotary shaft 61*x* by the drive force of the motor. Similarly, the opening/closing device 62 includes a motor that rotationally drives the rotary shaft 62*x*. The toilet seat 31 can be electrically opened and closed by rotating the rotary shaft 62*x* by the drive force of the motor.

The deodorizing device 63 deodorizes air drawn from outside the casing. For example, the deodorizing device 63 suctions the air inside the bowl of the toilet 10, deodorizes the suctioned air, and exhausts the air outside the casing 40. An exhaust port 44 that exhausts the air deodorized by the deodorizing device 63 outside the casing 40 is provided in the back surface 40*r* (the back surface) of the casing 40.

Specifically, the deodorizing device 63 includes, for example, a duct part 63*a*, and a fan 63*b* located inside the duct part 63*a*. By operating the fan 63*b*, the air inside the bowl of the toilet 10 is drawn into the duct part 63*a*. For example, the drawn air odorous components (e.g., ammonia, etc.) included in the air are deodorized by being removed from the air by contact with a deodorizing part (e.g., water, etc.) located inside the duct part. The deodorized air passes through the duct part 63*a* and is exhausted backward of the casing 40 through the exhaust port 44.

The drive force of the nozzle motor 64*m* causes the washing nozzle 64 to advance from the interior of the casing 40 into the bowl and to retreat into the casing 40. When the user is sitting on the toilet seat 31, the washing nozzle 64 discharges wash water toward the private part of the user while being advanced frontward from the interior of the casing 40.

The control circuit 65 controls the operations of the opening/closing device 61, the opening/closing device 62, the deodorizing device 63, the nozzle motor 64*m*, etc. The control circuit 65 includes, for example, an electrical circuit that includes a microcomputer, etc.

A part of the sidewall part 52 of the toilet lid 50 (see FIG. 1) is positioned on the upper surface 42*u* of the side part 42 in the state in which the toilet lid 50 is closed. As illustrated in FIG. 1, the side surface of the toilet device 100 is formed of a surface 52*s* of the sidewall part 52 of the toilet lid 50, the side surface 42*s* of the side part 42 of the casing 40, a surface 20*s* of the cover 20, and the surface 11*s* of the toilet 10 in the state in which the toilet lid 50 is closed.

Figure 6:
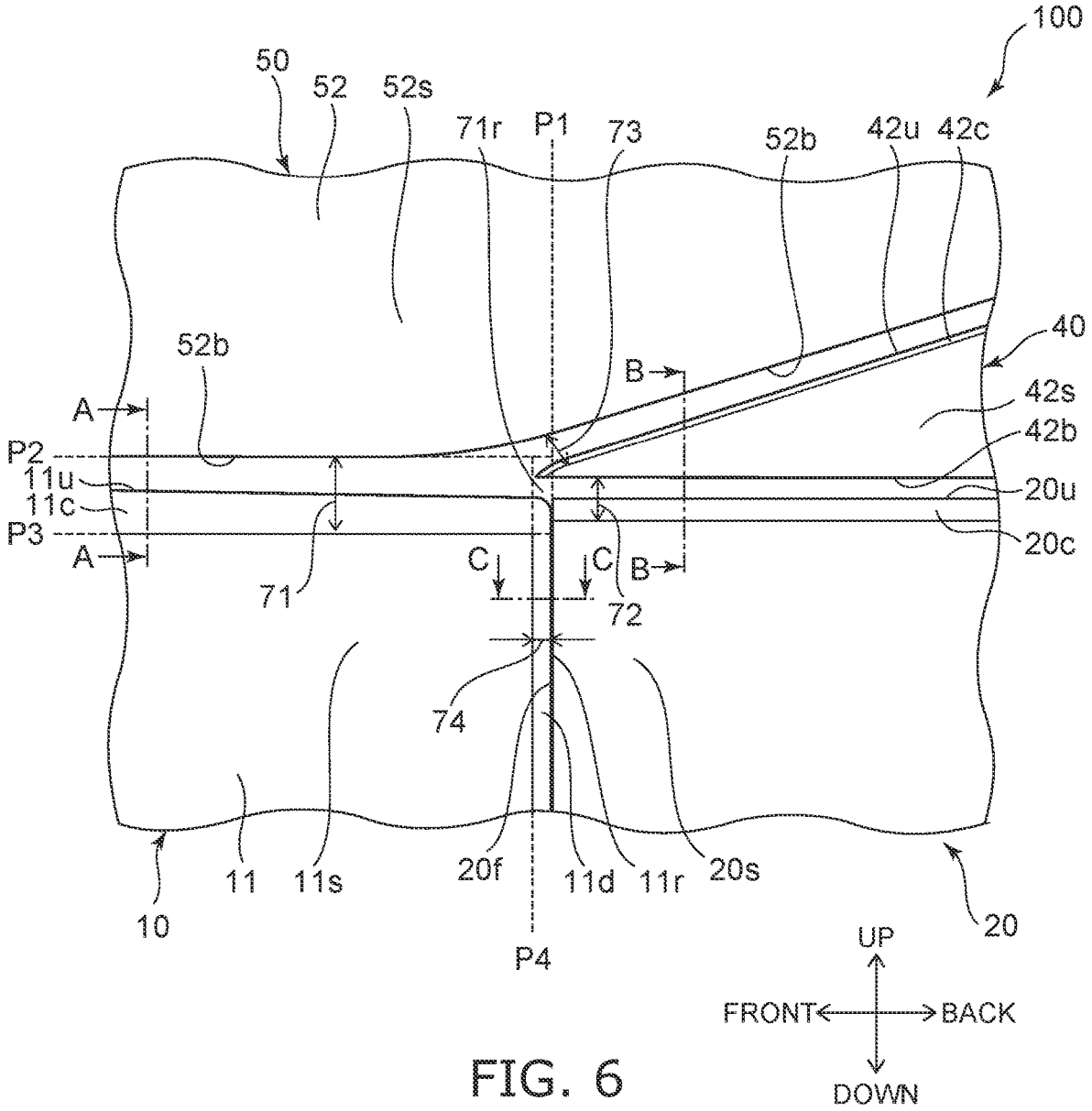
FIG. 6 is a side view illustrating the toilet device according to the embodiment.

FIG. 6 is a side view illustrating the toilet device according to the embodiment.

FIG. 6 is an enlarged illustration of the vicinity of an area R1 shown in FIG. 1. As illustrated in FIG. 6, first to fourth gaps 71 to 74 are provided in the toilet device 100 when viewed laterally.

The first gap 71 is a gap between the closed toilet lid 50 and the toilet 10. Specifically, the range in the vertical direction of the first gap 71 is between the surface 52*s* of the toilet lid 50 and the surface 11*s* of the toilet 10 when viewed in side-view. The range of the first gap 71 is defined by a position P1, a position P2, and a position P3 when viewed in side-view as in FIG. 6. The position P1 is the position of a back surface 11*r* (e.g., the upper end part of the back surface 11*r*) of the toilet 10 (the sidewall part 11) in the longitudinal direction. The position P2 is the position in the vertical direction of the lower end of the surface 52*s*. The position P3 is the position in the vertical direction of the upper end of the surface 11*s*.

The second gap 72 is a gap between the casing 40 and the cover 20. Specifically, the second gap 72 is the gap between the side surface 42*s* of the casing 40 and the surface 20*s* of the cover 20 when viewed in side-view.

The third gap 73 is a gap between the casing 40 and the closed toilet lid 50. Specifically, the third gap 73 is the gap between the side surface 42*s* of the casing 40 and the surface 52*s* of the toilet lid 50 when viewed in side-view.

The fourth gap 74 is a gap between the toilet 10 and the cover 20. Specifically, the fourth gap 74 is the gap between the surface 11*s* of the toilet 10 and the surface 20*s* of the cover 20 when viewed in side-view.

As illustrated in FIG. 6, the second gap 72, the third gap 73, and the fourth gap 74 each are connected to a back end portion 71*r* of the first gap 71 when viewed laterally. The end parts of the second gap 72, the third gap 73, and the fourth gap 74 are continuous with the back end portion 71*r* of the first gap and directly connect with the back end portion 71*r*. In other words, for example, the first to fourth gaps 71 to 74 cross at, or extend from, one point (the back end portion 71*r*).

The range in the longitudinal direction of the back end portion 71*r* of the first gap 71 is, for example, the range of the first gap 71 from the position P1 to a position P4. The position P4 is the position in the longitudinal direction of the back end of the surface 11*s* (e.g., the upper end part of the surface 11*s*). The range in the longitudinal direction of the back end portion 71*r* may be not more than 2.5 cm (centimeters), not more than 2.0 cm, or not more than 1.5 cm frontward of the position P1.

When viewed laterally as in FIG. 6, at least a part of the fourth gap 74 is arranged with at least a part of the third gap 73 in the vertical direction. For example, at least a part of the upper end of the fourth gap 74 overlaps at least a part of the lower end of the third gap 73 in the vertical direction.

Figure 7:
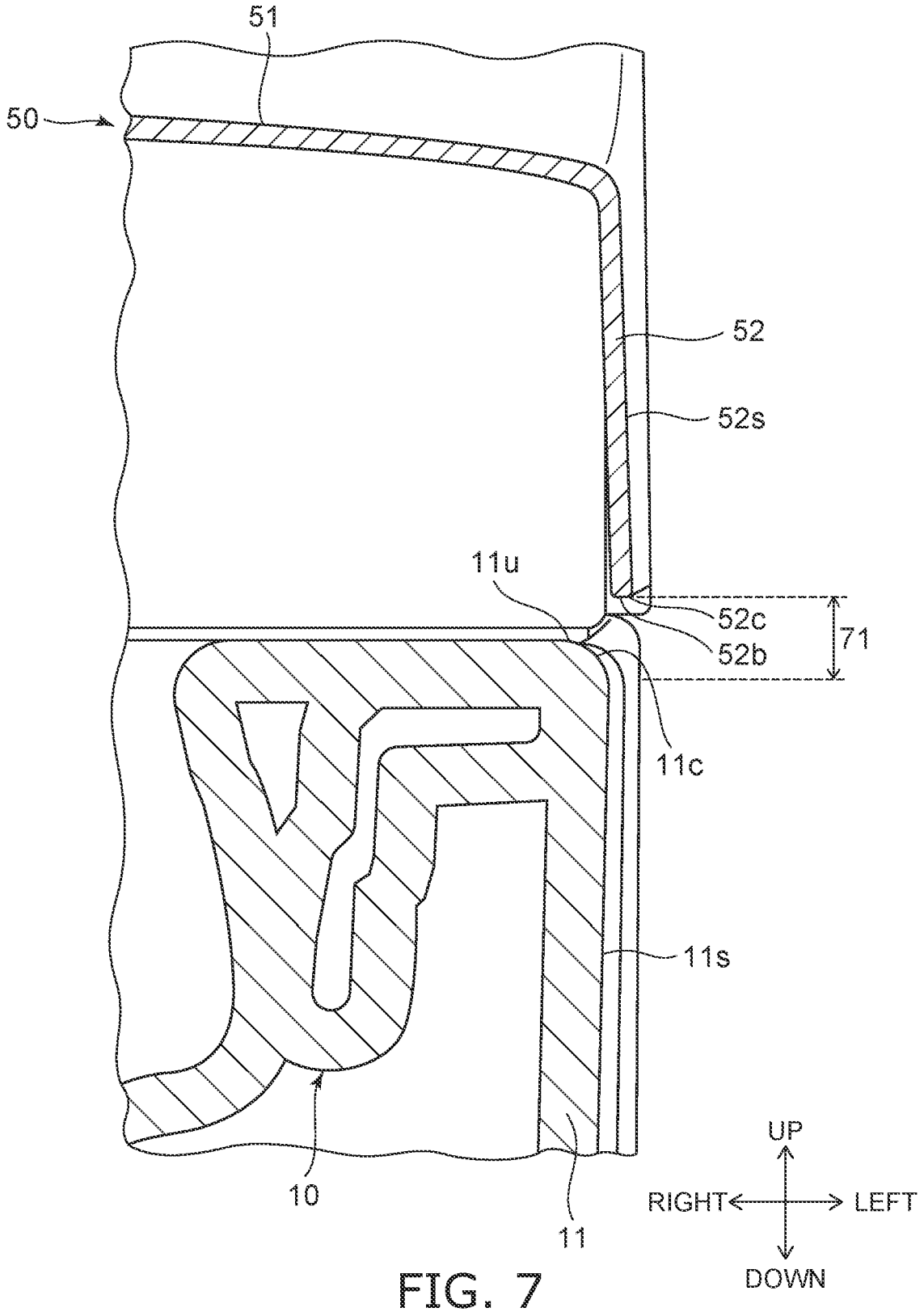
FIG. 7 is a cross-sectional view illustrating the toilet device according to the embodiment.

FIG. 7 is a cross-sectional view illustrating the toilet device according to the embodiment.

FIG. 7 is a cross section along line A-A shown in FIG. 6. As illustrated in FIG. 7, the sidewall part 11 of the toilet 10 includes the surface 11*s* (the side surface), a connection surface 11*c*, and an upper surface 11*u*. The surface 11*s* extends along the vertical direction (e.g., the vertical direction). The upper surface 11*u* faces upward and extends along the longitudinal direction (e.g., the horizontal direction). The surface 11*s* and the upper surface 11*u* each are, for example, planes. The connection surface 11*c* is a curved surface (a corner) connecting the surface 11*s* and the upper surface 11*u*.

The sidewall part 52 of the toilet lid 50 includes the surface 52*s*, a lower surface 52*b*, and a connection surface 52*c*. The surface 52*s* extends along the vertical direction. The lower surface 52*b* faces downward and extends along a direction (e.g., the longitudinal direction) crossing the vertical direction. The surface 52*s* and the lower surface 52*b* each are, for example, planes. The connection surface 52*c* is a curved surface (a corner) connecting the surface 52*s* and the lower surface 52*b*.

As illustrated in FIG. 7, the range in the vertical direction of the first gap 71 is between the surface 11*s* and the surface 52*s* when viewed laterally.

Figure 8:
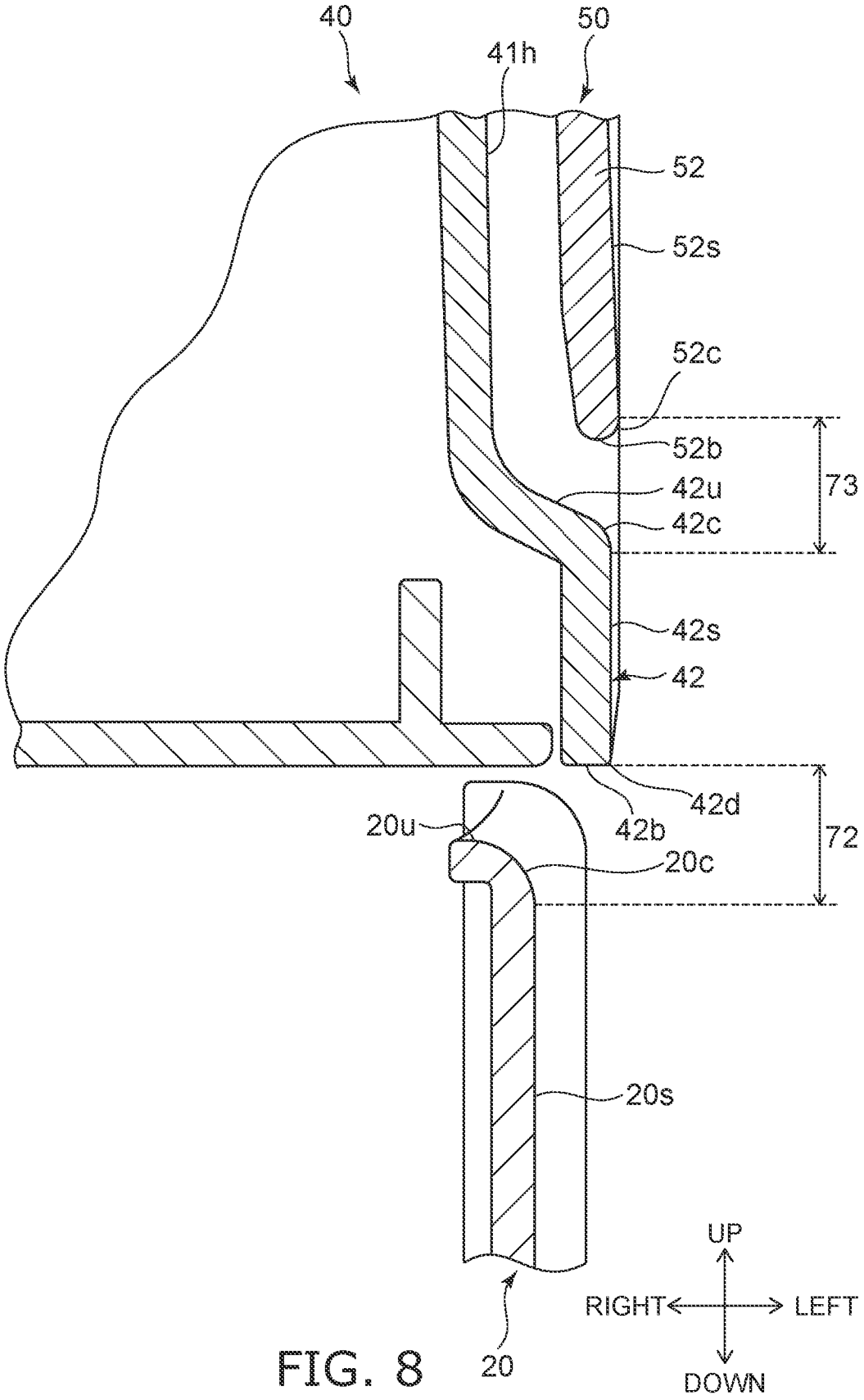
FIG. 8 is a cross-sectional view illustrating the toilet device according to the embodiment.

FIG. 8 is a cross-sectional view illustrating the toilet device according to the embodiment.

FIG. 8 is a cross section along line B-B shown in FIG. 6. As illustrated in FIG. 8, the cover 20 includes the surface 20*s*, an upper surface 20*u*, and a connection surface 20*c*. The surface 20*s* extends along the vertical direction (e.g., the vertical direction). The upper surface 20*u* faces upward and extends along the longitudinal direction (e.g., the horizontal direction). The surface 20*s* and the upper surface 20*u* each are, for example, planes. The connection surface 20*c* is a curved surface (a corner) connecting the surface 20*s* and the upper surface 20*u*.

The side part 42 of the casing 40 includes the side surface 42*s*, a lower surface 42*b*, the upper surface 42*u*, a connection surface 42*c*, and a connection surface 42*d*. The side surface 42*s* extends along the vertical direction (e.g., the vertical direction). The lower surface 42*b* faces downward and extends along the longitudinal direction (e.g., the horizontal direction). The upper surface 42*u* faces upward and extends along a direction (e.g., the longitudinal direction) crossing the vertical direction. As illustrated in FIG. 8, the upper surface 42*u* may be inclined with respect to the lateral direction. The side surface 42*s*, the lower surface 42*b*, and the upper surface 42*u* each are, for example, planes. The connection surface 42*c* is a curved surface (a corner) connecting the side surface 42*s* and the upper surface 42*u*. The connection surface 42*d* is a curved surface (a corner) connecting the side surface 42*s* and the lower surface 42*b*.

As illustrated in FIG. 8, the second gap 72 is the gap between the surface 20*s* and the side surface 42*s* when viewed laterally. The third gap 73 is the gap between the surface 52*s* and the side surface 42*s* when viewed laterally.

Figure 9:
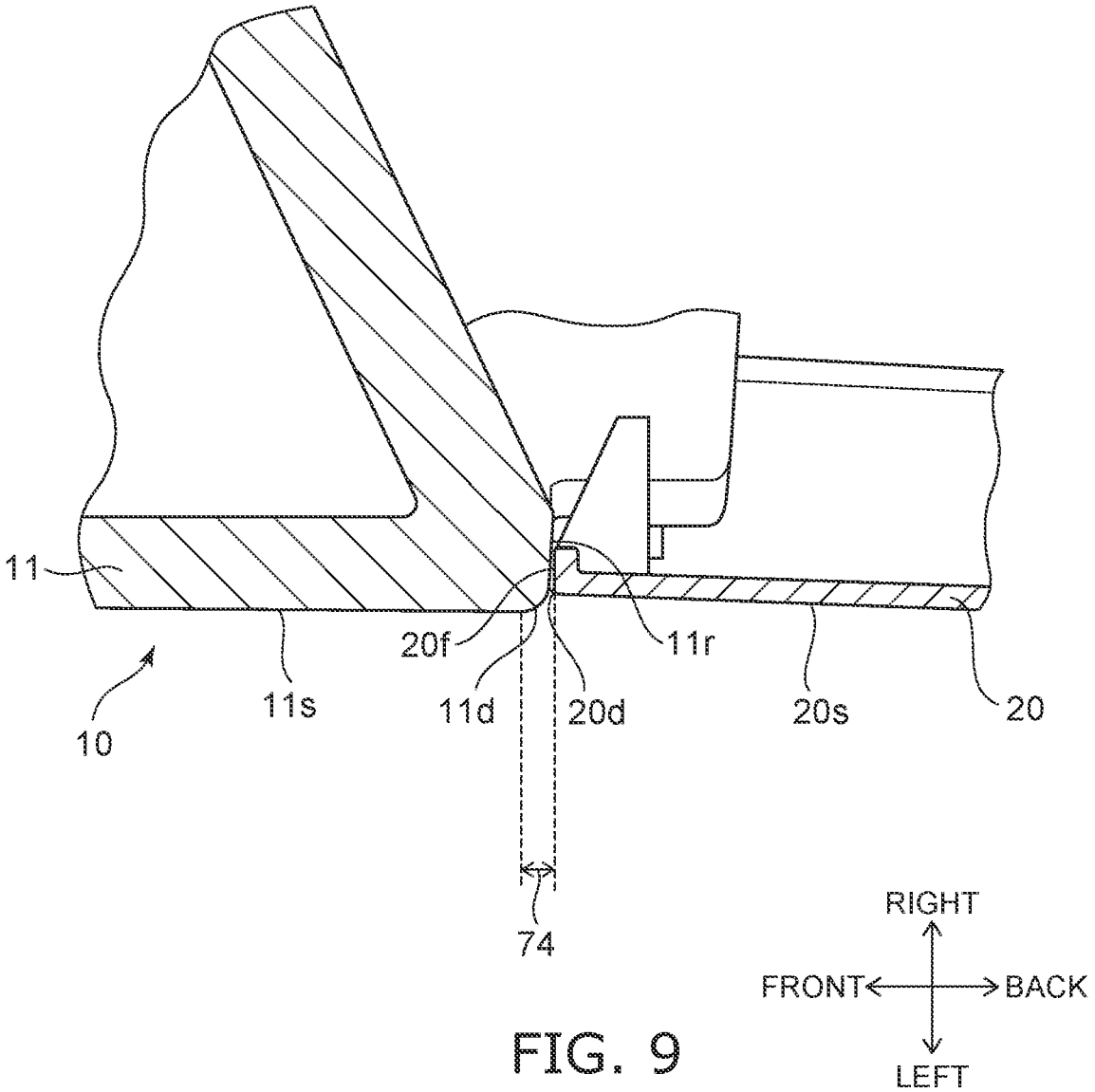
FIG. 9 is a cross-sectional view illustrating the toilet device according to the embodiment.

FIG. 9 is a cross-sectional view illustrating the toilet device according to the embodiment.

FIG. 9 is a cross section along line C-C shown in FIG. 6. As illustrated in FIG. 9, the sidewall part 11 of the toilet 10 further includes the back surface 11*r* and a connection surface 11*d*. The back surface 11*r* faces backward and extends along the vertical direction (e.g., the vertical direction). The back surface 11*r* is, for example, a plane. The connection surface 11*d* is a curved surface (a corner) connecting the surface 11*s* and the back surface 11*r*.

The cover 20 further includes a front surface 20*f* and a connection surface 20*d*. The front surface 20*f* faces frontward and extends along the vertical direction (e.g., the vertical direction). The front surface 20*f* is, for example, a plane. The front surface 20*f* may contact the back surface 11*r*, or spacing may be provided between the front surface 20*f* and the back surface 11*r*. The connection surface 20*d* is a curved surface (a corner) connecting the surface 20*s* and the front surface 20*f*.

As illustrated in FIG. 9, the fourth gap 74 is the gap between the surface 11*s* and the surface 20*s* when viewed laterally. In the example, the fourth gap 74 extends in the vertical direction.

The connection surfaces (the connection surfaces 11*c*, 11*d*, 20*c*, 20*d*, 42*c*, 42*d*, and 52*c*) are provided as necessary, may be omitted, and may not always be curved surfaces (e.g., R-surfaces). For example, the connection surfaces may be planes (e.g., C-surfaces).

There are cases where contaminants such as water, etc., adhere to the third gap 73 between the casing 40 and the toilet lid 50, travel along the casing 40, and reach the toilet 10 or the cover 20 located below the casing 40. For example, there are cases where water travels along the upper surface 42*u* of the side part 42 of the casing 40 and flows to the upper surface 11*u* of the sidewall part 11 of the toilet 10 or the upper surface 20*u* of the cover 20. In such a case, contaminants such as water, etc., that reach the toilet 10 or the cover 20 may flow into a wide area below (underneath) the casing 40; and there is a risk that the hassle of cleaning may be increased. For example, it is considered that water may undesirably spread to the upper surface 20*u* of the cover 20 and/or the upper surface 11*u* of the toilet 10 positioned below the side part 42 of the casing 40.

In contrast, according to an example, the second to fourth gaps 72 to 74 each are connected to the back end portion 71*r* of the first gap 71 as described above with reference to FIG. 6; and the end parts of the first to fourth gaps 71 to 74 are proximate to each other. Accordingly, for example, contaminants such as water, etc., that reached the upper surface of the toilet 10 or the cover 20 from the third gap 73 between the casing 40 and the toilet lid 50 can be easily entered the fourth gap 74 between the toilet 10 and the cover 20. Therefore, the undesirable spreading of contaminants such as water, etc., to the upper surfaces of the toilet 10 and the cover 20 positioned below the casing 40 can be suppressed, and the cleanability can be improved.

For example, it is difficult to visually check or clean below (underneath) the casing 40, and it is likely that the cleaning below (the casing 40 may be insufficient. In contrast, compared to underneath the casing 40, the fourth gap 74 between the toilet 10 and the cover 20 is easily checked visually, and can be cleaned relatively easily by, for example, detaching the cover 20.

Also, when mounting the cover 20, the cover 20 can be mounted by using the point at which the gaps cross as a visual guide to align the corner of the cover 20. The cover 20 is easily mounted thereby.

The fourth gap 74 extends in the vertical direction. Accordingly, the length of the fourth gap 74 can be less than when the fourth gap 74 is inclined with respect to the vertical direction. In other words, the gap in which contaminants such as water, etc., are likely to collect can be narrow (short).

As described above with reference to FIG. 1, FIG. 2, etc., the toilet lid 50 in the closed state covers the upper surface 41*u* of the casing 40. Because the toilet lid 50 covers the upper surface 41*u* of the casing 40, the penetration of water droplets and/or dust between the toilet lid 50 and the upper surface 41*u* of the casing 40 can be suppressed. Also, because the toilet lid 50 covers the upper surface 41*u* of the casing 40, the position of the center of gravity of the toilet lid 50 can be moved backward. Accordingly, it is easy for the opening/closing device 61 to open and close the toilet lid 50. That is, the center-of-gravity position of the toilet lid 50 is easily moved backward by extending the toilet lid 50 backward so that the toilet lid 50 covers the upper surface 41*u* of the casing 40. The distance between the center of gravity of the toilet lid 50 and the rotary shaft of the opening/closing device 61 supporting the back end portion of the toilet lid 50 can be reduced thereby, and it is easy for the opening/closing device 61 to open and close the toilet lid 50. As a result, for example, the opening/closing device 61 can be made smaller, and the casing (the toilet seat device) can be made smaller. For example, the height of the toilet seat device 30 can be reduced. Specifically, for example, the height (the length in the vertical direction) of the toilet seat device 30 in the state in which the toilet lid 50 is closed is not more than ⅓ times the height (the length in the vertical direction) of the toilet 10.

As described above with reference to FIG. 5, etc., the exhaust port 44 that exhausts the air deodorized by the deodorizing device 63 outside the casing 40 is provided in the back surface 40*r* of the casing 40. Thus, dirt and/or water droplets from the exhaust port 44 can be prevented from entering the casing by providing the exhaust port 44 in the back surface 40*r*.

As illustrated in FIGS. 4 and 5, a straight line L2 that extends through a boundary part 40*rc* between the first inclined surface 40*ra* and the second inclined surface 40*rb* of the back surface 40*r* of the casing 40 crosses a straight line L1 that extends through the third gap 73. That is, the position of the corner of the back surface 40*r*, i.e., the boundary part 40*rc*, is aligned with the position of the corner of the side part 42 of the casing forming the third gap 73. More specifically, the height of the back end of the upper surface 42*u* of the side part 42 matches the height of the boundary part 40*rc*. The back end of the upper surface 42*u* is connected to the boundary part 40*rc*. Thus, by aligning the third gap 73 and the position of the boundary part 40*rc*, the designability can be improved. Also, the cleanability can be improved because the shape of the casing 40 is simple.

The invention has been described with reference to the embodiments. However, the invention is not limited to these embodiments. Any design changes in the above embodiments suitably made by those skilled in the art are also encompassed within the scope of the invention as long as they fall within the spirit of the invention. For example, the shape, the size the material, the disposition and the arrangement or the like of the components included in the toilet device and the toilet seat device are not limited to illustrations and can be changed appropriately.

The components included in the embodiments described above can be combined to the extent possible, and these combinations are also encompassed within the scope of the invention as long as they include the features of the invention.

What is claimed is:

1. A toilet device, comprising:

a toilet;

a cover laterally covering a back part of the toilet;

a casing located on the toilet; and a toilet lid rotatably supported with respect to the casing, the toilet lid covering an entire upper surface of the casing when the toilet lid is in a closed state, a second gap between the casing and the cover, a third gap between the casing and the closed toilet lid, and a fourth gap between the toilet and the cover each being connected to a back end portion of a first gap, the first gap being between the toilet and the closed toilet lid when viewed laterally, wherein the toilet device further comprises a rotary shaft for opening and closing the toilet lid, wherein a pair of recesses is provided in a back part of the upper surface of the casing, the rotary shaft is located in the recesses, and an engaging part of the toilet lid is connected to the rotary shaft, wherein the casing includes:

a pair of first side surfaces;

a pair of second side surfaces located under the pair of first side surfaces, respectively, each of the second side surfaces being located outside of each of the first side surfaces in a lateral direction of the casing; and a connection surface connecting an upper side of each of the second side surfaces to each of the first side surfaces, having a downward slope from the back part of the toilet toward a front part of the toilet, and facing upward and forward, wherein the third gap extends along the connection surface, wherein a front end of the connection surface is located above the fourth gap when viewed laterally, wherein each of the first side surfaces includes a front portion extending from the front end of the connection surface in a longitudinal direction of the casing and a back portion located behind the front portion, and wherein each of the second side surfaces is located under the back portion of each of the first side surfaces, respectively.

2. The toilet device according to claim 1, wherein the fourth gap extends vertically at an angle perpendicular to a flat toilet base/level ground when viewed in a side view.

3. The toilet device according to claim 1, further comprising:

an opening/closing device that opens and closes the toilet lid.

4. The toilet device according to claim 1, further comprising:

a deodorizing device located in the casing, the deodorizing device deodorizing air drawn from outside the casing, the casing having an exhaust port provided in a back surface of the casing, the exhaust port exhausting the air deodorized by the deodorizing device.

5. The toilet device according to claim 1, wherein a back surface of the casing includes:

a first inclined surface; and a second inclined surface that is inclined more than the first inclined surface with respect to a vertical direction, and a straight line extending through a boundary part between the first inclined surface and the second inclined surface crosses a straight line extending through the third gap.

6. The toilet device according to claim 1, wherein the third gap between the casing and the closed toilet lid extends linearly.

7. The toilet device according to claim 1, wherein a connection surface connecting a side surface of the toilet extending along a vertical direction and an upper surface of the toilet facing upward and extending along a horizontal direction at a sidewall part of the toilet has a width greater than a connection surface connecting a surface of the cover extending along the vertical direction and an upper surface of the cover facing upward and extending along the horizontal direction at the cover, when the toilet device is viewed laterally.

8. The toilet device according to claim 1, wherein a connection surface connecting a side surface of the toilet extending along a vertical direction and an upper surface of the toilet facing upward and extending along a horizontal direction at a sidewall part of the toilet has a width greater than each of a connection surface connecting a surface of the cover extending along the vertical direction and an upper surface of the cover facing upward and extending along the horizontal direction at the cover and a connection surface connecting a side surface of the casing extending along the vertical direction and an upper surface of the casing facing upward and extending along the horizontal direction at a side part of the casing, when the toilet device is viewed laterally.

9. The toilet device according to claim 1, wherein a connection part of the cover is mounted directly to the toilet without the casing, and wherein the connection part is a magnet.

* * * * *